United States Patent [19]

Wuttudal

[11] Patent Number: 4,601,252

[45] Date of Patent: Jul. 22, 1986

[54] TURRET FOR MOORING VLCC SIZE VESSELS

[76] Inventor: Hermann Wuttudal, 830 Nantucket, Beaumont, Tex. 77706

[21] Appl. No.: 567,744

[22] Filed: Jan. 3, 1984

[51] Int. Cl.[4] ..... B63B 21/00

[52] U.S. Cl. ..... 114/230; 441/3

[58] Field of Search ..... 114/230, 293; 441/3-5; 405/195, 224

[56] References Cited

U.S. PATENT DOCUMENTS

| | | | |
|---|---|---|---|
| 3,602,175 | 8/1971 | Morgan et al. | 114/293 |
| 3,735,435 | 5/1973 | Mikulicic et al. | 441/5 |
| 3,739,736 | 6/1973 | Carreau et al. | 114/293 |
| 3,774,562 | 11/1973 | Dean | 114/293 |
| 3,886,887 | 6/1975 | Cunningham et al. | 114/230 |
| 4,281,613 | 8/1981 | Ray et al. | 114/293 |
| 4,305,341 | 12/1981 | Stafford | 114/230 |

OTHER PUBLICATIONS

Mechanical Engineering Design, 4th Edition, Shigley et al, McGraw-Hill, pp. 503, 516, 517.

*Primary Examiner*—Trygve M. Blix
*Assistant Examiner*—Stephen P. Avila

[57] ABSTRACT

A turret journaled in a vessel used in an offshore location wherein the mooring system is carried by the turret and the vessel is free to weathervane over a subsea wellhead or the like. Illustrated is a VLCC size ship-shape vessel of approximately 300,000 ton displacement for waterdepths of up to 6,000 feet, but latter is no limit. The turret uses segmented bearings under liquid pressure to obtain low friction and allows the vessel to rotate with turret under static and dynamic, and symmetrical and asymmetric loads (e.g., may exceed 30,000,000 pounds). The turret provides a carousel about the moonpool (e.g., 120 feet in diameter) for carrying compartments with winches, utility and storage functions, and topside skids for drilling rigs or other heavy machinery.

32 Claims, 11 Drawing Figures

TURRET FOR MOORING VLCC SIZE VESSELS

BACKGROUND OF THE INVENTION

1. Field of the Invention

This invention relates to ships and excavating systems and it more particularly relates to moored offshore vessels, such as drilling and petroleum production vessels. It may equally well function as a shore based heavy duty bearing system, and as a swiveling system for stationary or dynamic loads.

2. Description of the Prior Art

Offshore vessels used in the drilling and production of petroleum, subsea mining or recovery are often best moored by a plurality of radially positioned anchors or heavy foundations set in the sea floor with mooring lines connected to the vessel. The mooring lines can be steel cables, chains, synthetic fiber ropes or a combination thereof.

Naturally, the vessel moored by this arrangement will turn in response to current, wave, and wind forces. One system allowing the vessel to weathervane employs a turret journaled in the forward part of the hull. This will allow the vessel to head into the environmental excitation vector. The mooring lines are secured to the turret, which remains stationary about a vertical axis during angular movements of the weathervaning vessel.

Priorly, the largest vessel with a turret mooring system had a deplacement of about 30,000 tons, although larger units have been proposed. The earliest turret was journaled using metal rollers on a steel raceway. Even with roller bearings, it is believed that a power assist mechanism is needed to rotate the turret to allow changing direction of the vessel. The reason for this situation resides in the coefficient of friction of metal-to-metal bearing under eccentric and dynamic load (e.g., estimated at $u=0.2$). Thus, on a vessel of even this modest size, the frictional forces and resulting torques resisting rotation in the turret can be of significant magnitude.

As the water depth increases wherein drilling and especially production and mining operations are desired, the size of the vessel should also increase so as to provide sufficient work room and support capability. The requirement for size naturally also increases with the magnitude of field under exploitation. In the case of a VLCC size vessel, it would measure more than 1,000 feet, and in order to take full advantage of the vessel size, a moonpool or turret diameter exceeding 70 feet is natural. A VLCC size vessel normally ranges from 200,000 to 350,000 tons displacement.

If a turret with roller bearings is to be used on a VLCC vessel, an equally distributed load in the 30,000,000 pounds range would have a frictional resistance to rotation of about 3,000 tons. It is obvious that anchor ropes cannot safely stand the resulting tortional resistance to turret rotation. Therefore, a power assisted turret rotation arrangement would have to be used to protect the anchor ropes and to protect the bearings from accelerated wear. Even if the bearing surfaces of the turret could be made from a low coefficient of friction material such as Teflon, the frictional resistance to rotation would ideally exceed 100 tons, given service loading in the 10,000–15,000 ton range. Unfortunately, the use of this bearing material would be very expensive at present day prices, and cannot conceiveably be manufactured in the necessary size, while still retaining tolerances in the ideal range.

Another problem with a turret system for any vessel is in the flexing, especially longitudinally, of the bearing surfaces. For example, the vessel in sag and hog condition changes dimension longitudinally about its neutral axis of about 0.15%. Thus, the bearing housing secured to the vessel varies in elliptical form as the vessel changes from compression to tension conditions alternately at the main deck and bottom. On a turret of the mentioned size (e.g., 70 feet), this elliptical form can be a 2.5 inch change in major and minor diameters. There are no known steel roller bearing arrangements that can accommodate this elliptical distortion condition and yet retain tolerable friction losses.

The present invention is a unique turret system with a low friction fluid bearing (like water) that can function under severe conditions of elliptical distortion while allowing a vessel subject to weathervaning almost unrestricted freedom of rotation and at loads exceeding 30,000,000 pounds on the bearing surfaces. In addition, this new turret provides a compact mounting arrangement for various anchor and riser rope handling systems, including winches, storage and utility compartments, and top mounted skid beams for the support and transportation of extremely heavy machinery.

STATEMENT OF INVENTION

In accordance with this invention, there is provided an improved turret rotatable about a vertical axis within a support base (e.g., on a vessel) and operable under differential lateral and vertical loadings. The turret comprises a cylindrical spool carrying at least one radial bearing disk with a round vertical body rotatable about a vertical axis. The base receives the spool within enclosing walls. A rigid liner mounts within the disk and an elastomeric barrier resides within the base coextensively with the disk. Annular metal stopper members are fixed between the liner and disk for spacing same a minimum distance. The disk carries radial skirts for fluid throttling between the disk and liner, and the skirts extend between the stopper members so as to define a plurality of annular segmented cups encircling the disk. A source (e.g., pressurized reservoir) introduces pressurized liquid into each segmented cup and against the liner for maintaining the spool on its vertical level, and symmetrical with its vertical rotational axis in the base.

In the embodiments of the improved turret, the pressurized liquid application may be computer controlled and becomes dynamically captive in a throttled chamber between the spool and base, and dynamic pressure seals. Also, the turret can be provided with annular compartments to house mooring and riser rope winches and storage in carousel arrangement, together with top mounted skids for support and transportation of heavy machinery.

DESCRIPTION OF THE DRAWINGS

In the drawings, the several embodiments of the improved turret have common elements of construction. In regard to these several figures, like elements carry like numerals to simplify description of these improved turret embodiments.

DESCRIPTION OF PREFERRED EMBODIMENTS

Figure 1:
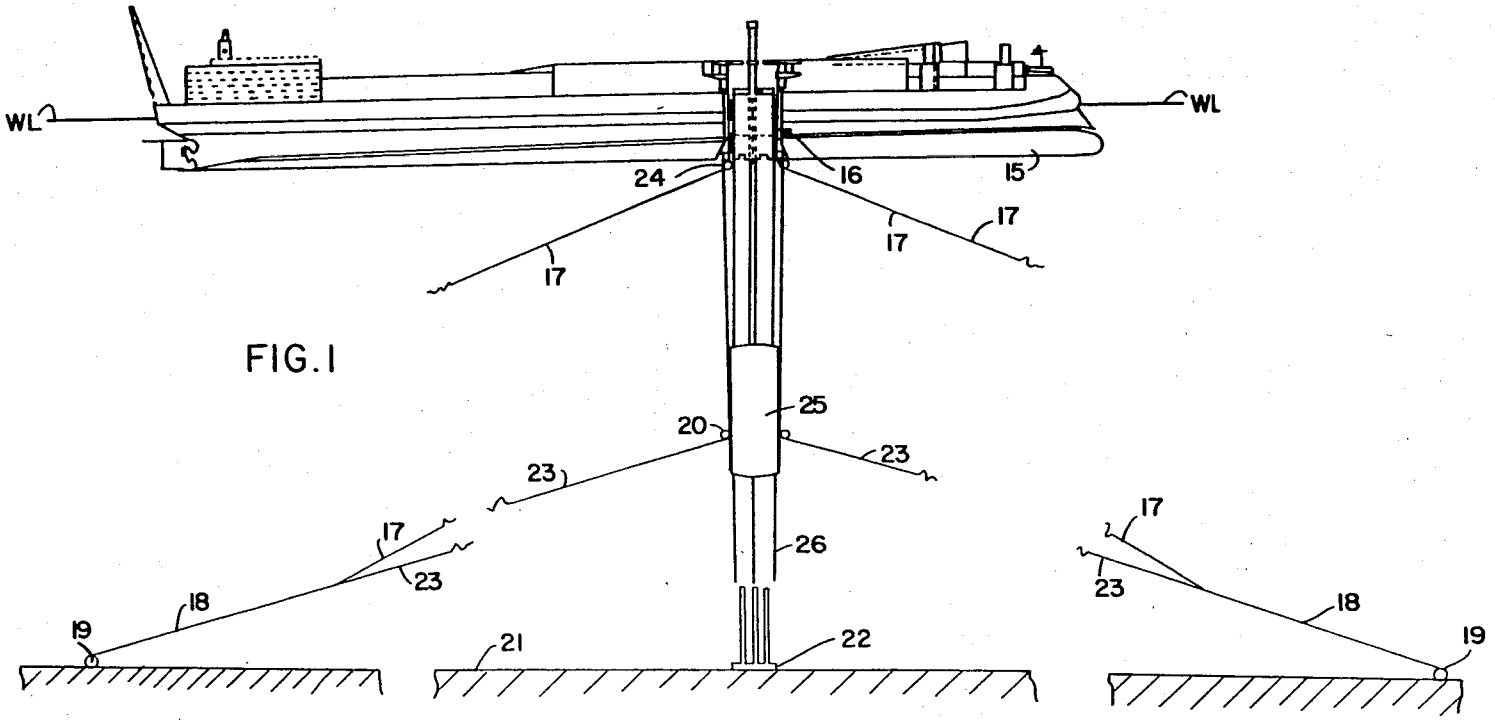
FIG. 1 is a pictorial view illustrating an offshore VLCC vessel carrying the improved turret for mooring same to radially placed mooring ropes and for controlling a multi-strand riser system extending to a sea floor wellhead template.

Referring to the drawings, and particularly to FIG. 1, there is shown a VLCC vessel 15 carrying the improved turret 16 for mooring to a plurality of mooring ropes 17 connected by anchor chains 18 to anchors 19 set in the seafloor 21. The VLCC vessel 15 can have a length of over 1000 feet at the waterline WL with a displacement of more than 350,000 tons. In order to secure the vessel 15 in operative position above a wellhead template 22, a plurality of the ropes 17 are radially placed relative to the ship. For example, sixteen ropes 17 can be used and each rope can be of seven inch diameter (double braided polyester rope) to withstand a breaking load of 1,250,000 pounds and a working load of 50,000–350,000 pounds. The length of each rope is related to the water depth above the seafloor 21. The usual length-to-depth ratio of each rope varies with water depth. The mooring lines in a 1,500 foot water depth would typically consist of 800'chains and 3,200'/long ropes.

The mooring ropes 17 are passed over sheeves 24 upon their entrance into the turret 16 so as to reduce sharp corner shear injury to them.

It will be obvious that turret 16 must remain rotationally static about a vertical axis in the vessel 15 as the latter turns (weathervanes) in response to wind, wave and current forces. Since the ropes 17 cannot withstand any significant twisting below the turret 16, the vessel must turn freely against the frictional resistance of the bearing mounting about the turret 16. For example, this frictional resistance must be greatly less than obtained by steel-to-steel bearings.

The turret 16 may also carry the several riser ropes 23 that are employed with handling a multiple riser string 26 extending to the wellhead template 22. The riser string 26 can include plural production, control and tubing members that must be held in tension for safe operation. For this purpose, a buoyancy member 25 (e.g., 10,000 tons gross) can be secured onto the string 26 and stabilized by the riser ropes 23 which extend from the turret 16, through sheeves 20 on the member 25 and then secured to the anchor chain 18. The riser ropes 23 are held under sufficient tension to center the member 25 relative to the wellhead template 22. The riser ropes may be of same construction, as the anchor ropes.

Figure 2:
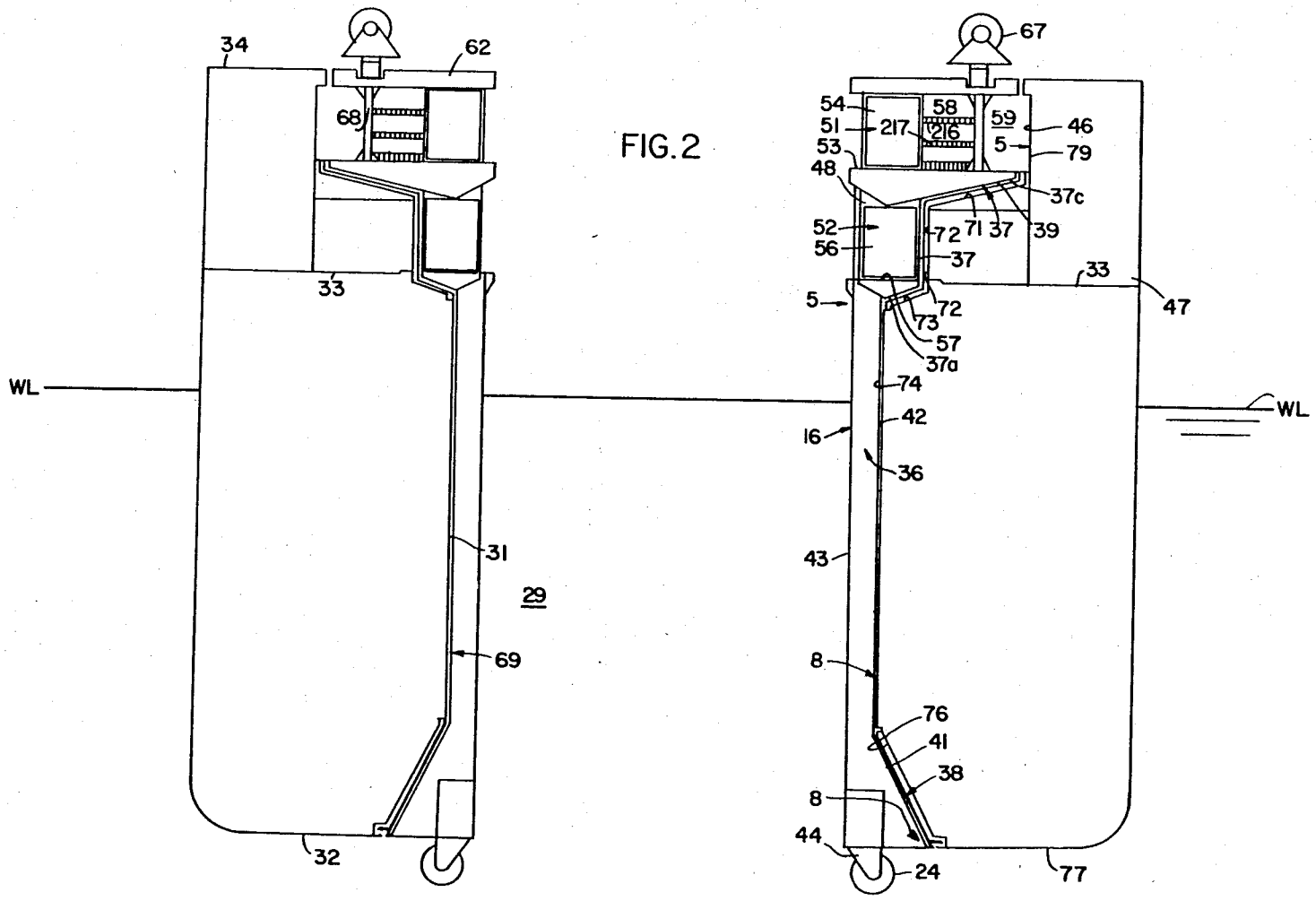
FIG. 2 is an enlarged cross section taken across the vessel at the turret.

Referring now to FIG. 2, the turret 16 is mounted within the moonpool 29 formed as a stepped cylindrical opening of varying diameter in the vessel 16. More particularly, the moonpool is defined by enclosing walls 31 which form a watertight enclosure within the hull of the vessel 16. These walls 31 extend between the vessel bottom 32, through the main deck 33 and terminate at top of upper turret bearing surface. The turret 16 extends as a tubular structure from the bottom 32, through a circular opening in the main deck 33, and it can terminate at the top or housedeck 34.

The turret 16 resembles a cylindrical spool carrying at least one radial bearing disk. Preferably, it has a round tubular vertical body 36 with upper and lower radial bearing disks 37 and 38, respectively. These disks are frusto-conical surfaces formed by the exterior wall plates of the turret, and these wall plates 39 and 41 merge into the exterior cylindrical wall 42 providing the body 36. The interior cylindrical wall 43 defines the remainder of the turret about the moonpool 29. The sheeves 24 for handling the mooring ropes 17 can be mounted by a complete fairleader assembly on supports 44 at the lower part of the wall 43 on the turret 16.

The disk 37 is formed in a stepped arrangement to reduce the vertical moment arms about bearing surfaces and to minimize the circular opening diameter required in the main deck 33. The disk has a first part 37A adjacent the wall 42 which radially connects with a cylindrical part 37B in traverse of the main deck and a third part 37C in its ultimate outward extension which terminates adjacent to the interior cylindrical wall 46 in the superstructure 47 below the house deck 34.

The upper turret is configured by bulkheads 48 into spaced annularly disposed compartments 51 and 52 respectively, above and below a circular deck 53. The compartments 51 can house winches 54 for handling the mooring ropes 17 while the compartments 52 can house on circular deck 57 the winches 56 for handling the riser ropes 23 or vice versa. Surrounding the compartments 51 are rope storage annulus 58 and utility annulus 59, which will be described in more detail hereafter.

Figure 4:
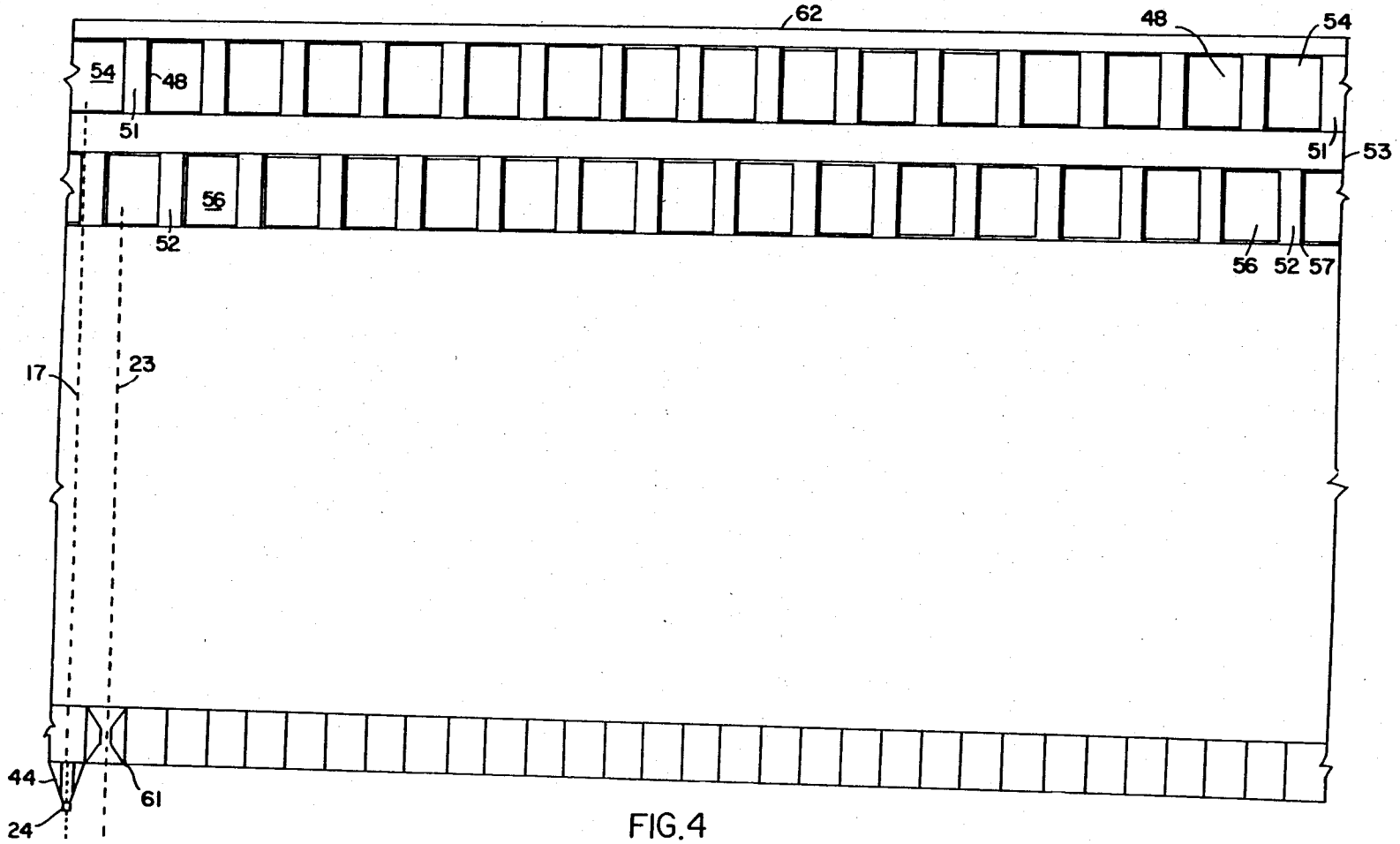
FIG. 4 is a linearized elevation of the turret taken from its center.

As best seen in FIG. 4, the arrangement of the compartments 51 are angularly staggered or offset relative to the compartments 52. As a result, the ropes 17 fall from the winches 54 in a spaced, side-by-side relationship to the ropes 23 (shown by chain lines). Since the ropes 23 fall downwardly in small angles from the winches 56, a lower guide 61 can be used to control them rather than a sheeve. With this arrangement for the turret 16, the several compartments etc. are carried in unison as in a carousel encircled by vessel 15.

Figure 3:
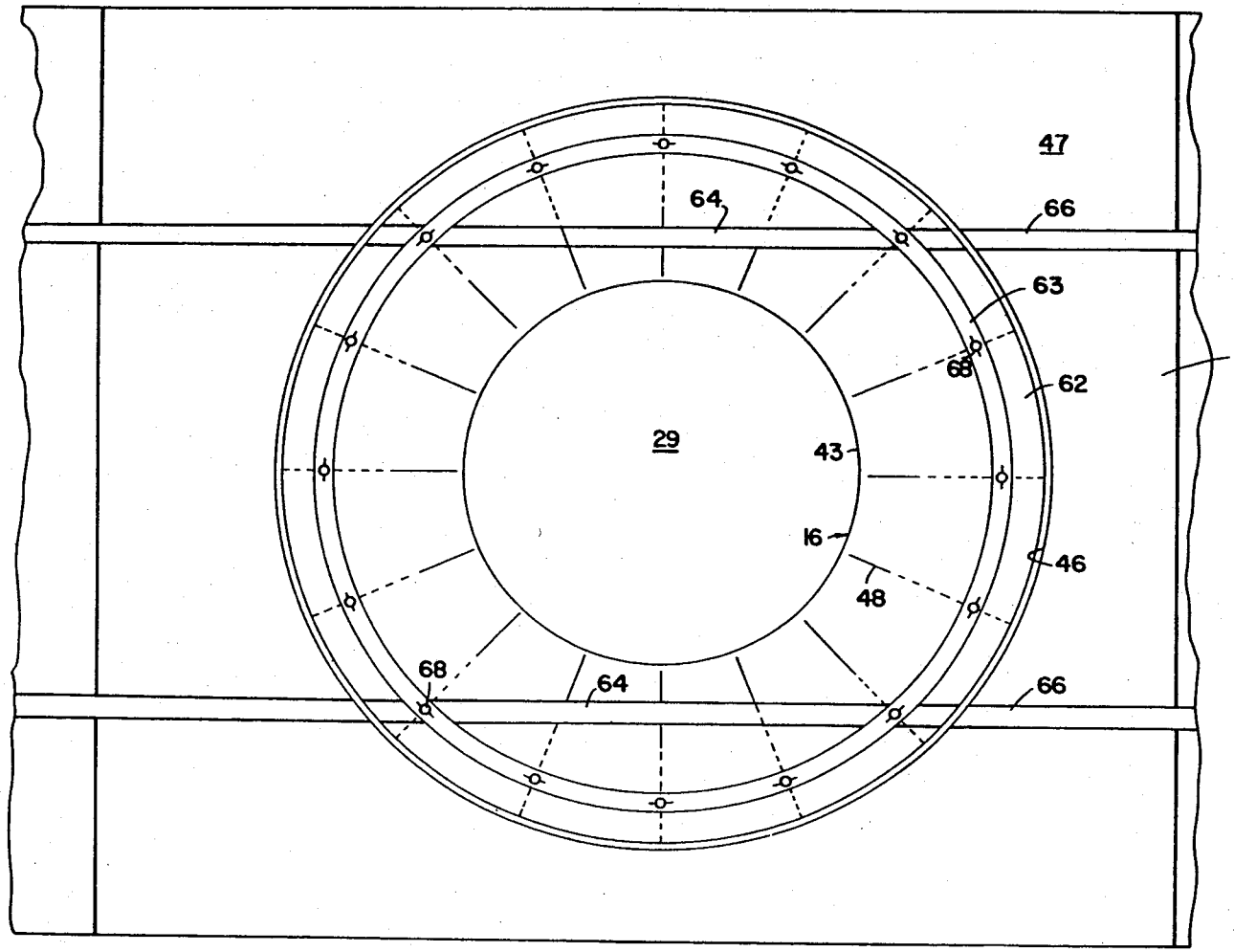
FIG. 3 is an enlarged partial plan taken of the vessel at the turret.

As seen in FIGS. 1, 2 and 3, the top of the turret at the house deck 34 is a circular work deck 62 that is arranged to handle the various deck machines and other equipment employed for drilling, production, mining or other subsea operations. The deck 62 has a recess mounting a circular skid beam 63, and also mounting parallel straight skid beams 64, which may be lined up upon turret rotation with beams 66 on the house deck 34. The various equipment used on the vessel can be moved to and from the turret by sliding over these skid beams. For example, large capacity winches 67 can be mounted to the skid 63 for furnishing mooring lines. These winches can be supported by stanchions 68 which extend between the decks 53 and 62.

The unique bearing arrangement to journal the turret within the vessel can be seen best in FIGS. 5–8. More particularly, the vessel carries a supporting base 69 to receive the turret. The base 69 is formed by connected walls 71, 72, 73, 74 and 76 that encircle the turret as the composite wall 31 and provide a water tight barrier about the moonpool 29 within the vessel. The wall 71 has an upturned lip 78 secured to a circular deck plate 79 carried on the wall 46. The walls 71–74 and 76–78 are spaced a small distance (e.g., 10 inches) from the walls of the turret. In this space, a stiff or rigid metal liners 80 and 81 and elastic medium 82 are integrally carried on the walls 71–78, and form essentially the supporting base 69 of the turret. However, the liners could be made of one element. Annular semicylindrical metal supports or stoppers 83–88 are integrally carried on the liner 81. These stoppers cooperate with the turret, especially the bearing disks 37 and 38 to (1) provide a certain minimum spacing (e.g., 2 inches) between the disks and liners, and (2) in combination within the skirts to provide an automatic throttling function, thus maintaining a centering dynamic fluid overpressure positioning the turret 16 within the base 69 during rotation and consequently accommodating eccentric loads. In normal operation of the turret (as with symmetrical or no loads), the turret will be centered with an equidistant clearance between all stoppers and respective disks. The supporting medium will be pressurized liquid, preferably water, introduced into the space 91 existing between the turret 16 and the liner 81 on the supporting base 69. Even though the turret may be subject to great (e.g., 30,000,000 pound) symmetrical or asymmetrical loading, the pressure of the liquid will be nominal (e.g., 40 psig range) because of the large surface areas of disks 37. Annular seals 90 and 90 seal the top and bottom of the turret 16 to the liners 80 and 81 so that space 91 becomes a near liquid tight chamber to receive pressurized fluid.

For example, the turret 16 may have a nominal diameter of about 120 feet with the annular surface area of the disk 37 being the difference from the turret light opening of about 70 feet. The pressurized liquid acting in space 91 represents a negligible friction at low relative angular velocities between the vessel and the turret. The resulting friction is practically speaking reduced to that of the seals 80 and 90. With seals as described herein, the friction is held at approximately 10 tons when the bearing load is about 15,000 tons, and a low angular velocity may be assumed. No twisting of the mooring ropes 17 occurs as the turret 16 remains free in the base 69 as the vessel weathervanes under action of wind, waves or currents.

If for any reason metal-to-metal contact between disks and stoppers occurs, the elastic medium 82 will allow the liners 80 and 81 to adjust and absorb such force without noticeable additional or deforming load on the enclosing walls 71–78. Stated in a different manner, the elastic medium 82 (of polymeric material) as a cushion allows the liners to float a few inches apart from the encircling walls so as to distribute the load under abnormal conditions, and until the pressurized liquid can restore the turret to its normal vertical axis and elevation in the vessel. Although intermittent slabs of synthetic rubber or other polymeric material is shown for the medium 82, it may be considered an equidistant clearance material between the stoppers 83–88 and the adjacent disks 37 and 38. The medium 82 may alternatively be formed by porous elastomeric polymers, or inflated spheres of suitable compressibility, suspended in a pressurized, incompressible liquid medium, such as water. This will constitute a liquid, elastic barrier with very quick response characteristics between the vessel 15 and liners.

The pressurized liquid is employed in a manner that the "down side" of the disk 37 can be restored without requiring excessive pressure in the space 91. For this purpose, and also as a dimensional tolerance means of adjustment, the disks 37 and 38 are provided with a plurality of angularly spaced, radially aligned resilient skirts 92 and 93, respectively. For example, each disk may carry eight equally spaced skirts. These skirts extend between a pair of adjacent stoppers so as to define a plurality of annular cups which encircle each of the disks. These skirts are preferably of a resilient material to accommodate variations in spacings between parts of the disk and the liner.

For example, the disk 37 at its upper part 37C carries skirts **92*a–h* between stoppers 84 and 85, at lower part 37A and skirts 92*i–o* are carried between stoppers 86 and 87. The lower disk 38 carries skirts 93*a–h* between the stoppers 88 and 89. It is important to note that the skirts provide a considerable throttle function to the liner 82 during eccentric movements of the turret. When the turret approaches seating upon the stoppers, a relatively fluid tight perimeter is established for the segmented cups between such stoppers. Thus, these stoppers cooperate with the skirts and disk in an automatic valve which throttles the segmented cups on the downside displacement of the turret in the base. For example, the disk 37, at part 37C is segmented into the cups 94–100 by the stoppers 84 and 85 and skirts 92*a–h*. In similar arrangement, the disk 38 is segmented into cups 107–114 by the stoppers 88 and 89 and the skirts 93*a–h*. Skirts 93*a–h*** may alternatively be made from a suitable metal material.

Figures 5, 7:
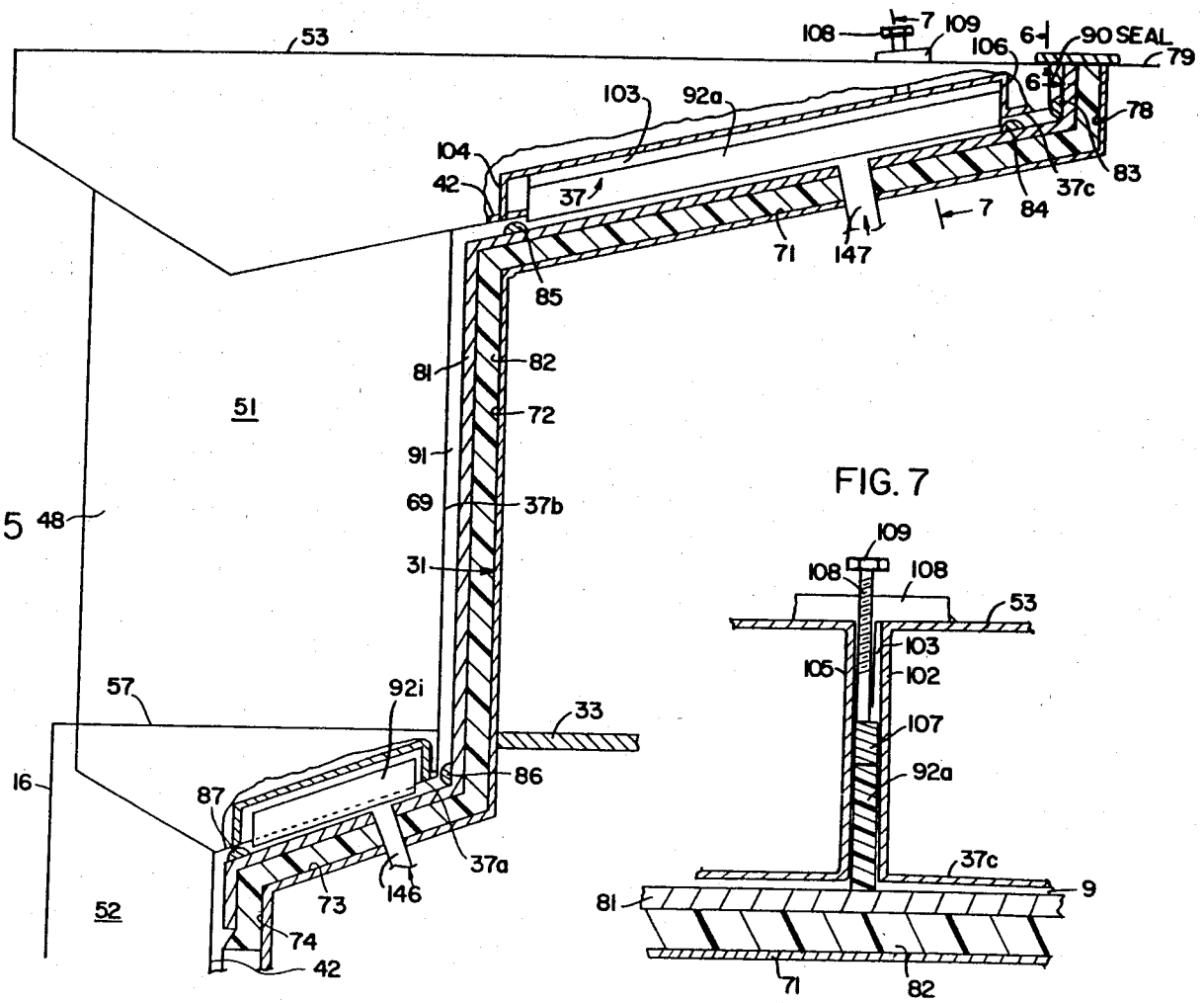
FIG. 5 is an enlarged cross section taken through the upper right portion of the turret along lines 5—5 of FIG. 2.
FIG. 7 is an enlarged section taken along lines 7—7 in FIG. 5.

The throttling tolerances of the skirts may be insured by a positioning mechanism illustrated in FIG. 7. The skirt is held between sidewalls 102 and 105 which are part of an enclosing fluid chamber 103 also defined by end walls 104 and 106 in the disk 37. The skirt 92A is urged into engagement with the liner 81 by a follower 107 through a suitable mechanism such as a jack screw 108 threadedly mounted in cover plate 109 secured to disk 53. The skirts maintain the desired fluid seal as the turret rotates and swings within the base 69. The remaining skirts **92*i–o* and 93*a–h*** may be provided with a similar positioning mechanism. However, the skirts may also be made from metal and actually welded in place. In that case the skirts are preferably fitted in the installation phase of the turret, such that the skirt installation also constitutes a final adjustment of system tolerances in a mechanical sense.

The liquid pressures in way of disk 37 create an upward force, a lift. Conversely the pressures in way of disk 38 creates a downward force on the turret. The differential force between disk 37 and 38 is the net balancing and vertically positioning force on the turret. The function of the lower disk 38 may be compared to that of a feed-back signal in a closed control loop, and the sensitivity of the system decreases with the horizontal projection of the disk 38. Conversely the lifting capacity at a given nominal pressure reduces with an increasing horizontal projection of disks 38. The actual pressure in way of disk 38 equals original feeding pressure less dynamic losses, and plus static head differential.

If assuming an increasing downward load on the turret, it will tend to sink within the base. However, now the throttling of liquid flow in way of upper disk's 37 skirts, stoppers, and liner becomes more pronounced, the dynamic pressure losses increase, and the resulting pressures and downward force at the lower disk 38 reduces.

Since a larger volume of liquids is needed in way of lower disk 38 cups, an underpressure zone will be established until the turret is stabilized. Thus, the effect in way of the lower disk 38 will assist in enhancing the adjustment of the differential balancing force, and reduces movement of the turret. Thus, the geometric lay-out is largely self-adjusting to varying load. In the case of a lesser downward pointing load, the opposite effects will occur, and the last statement prevails.

Assuming an eccentric downward load on top of the turret, it will naturally tend to drop on the side the eccentric load is applied. Thereby, an overpressure arises in way of upper disk's 37 cups directly underneath such load, and a tendency to underpressure will occur on the upper disk 37 opposing side, all due to distance variations between the disc/skirts and liners. In the lower disks 38, for the same reason an underpressure zone will occur on the side of the eccentric load, and conversely an overpressure on the opposite side. These emerging differential pressures will result in differential forces acting on the moment arms M1, M2 and M3. All arms are of substantial extention, and the resulting restoring moments will ascertain substantial stability against turret tilting in the base, even without any extra outside controlling measures. Significantly, the liquid passageways or space 91 through the turret are kept narrow compared to their length and liquid volumes. The integrating effect of this inherent dynamic throttle, will eliminate the necessity of compensation from an outside service system as far as dynamic impacts of relative short duration. (The described service system involving a computer and gas pressurized liquid containers for quick responses is nevertheess shown in a form that will service a system with needs for responsiveness greater than that of the turret configuration.)

Figure 9:
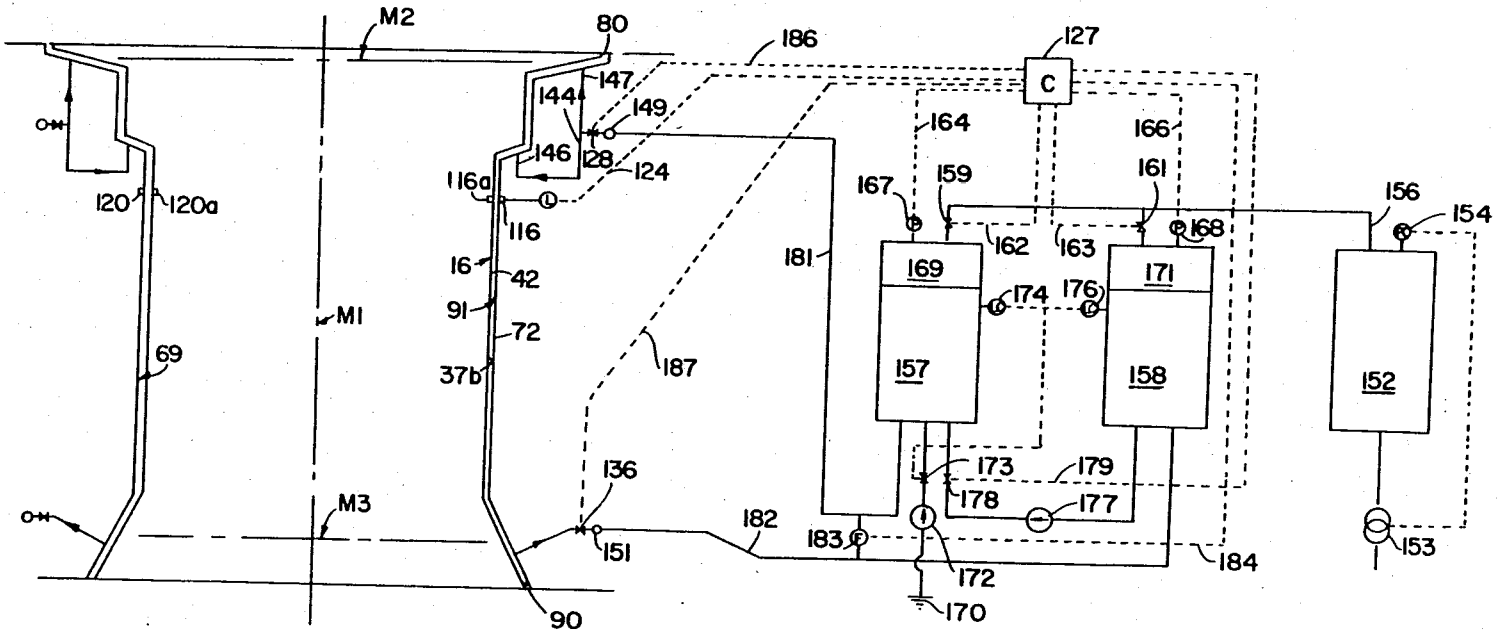
FIG. 9 is a hydraulic and control one line schematic showing a liquid pressure system for the improved turret.

The pressurized liquid is applied to each disk by the arrangement shown in FIG. 9. A plurality of sensors 116–123 and 116A–123A (e.g., sensors for measurement of vertical relative displacement) are placed, circumferentially about the turret on the walls 72 and 42. Preferably, there is an equal number of sensors to the number of segmented cup compartmentations in the disks. The sensors connect to signal devices "L" which provide an output signal proportional to the vertical spacing between the opposing sensors. The signal (indicated by chain line 124) is received at a computer 127 which based on these signals computes an output signal to initiate desired controlling function in application of pressurized liquid into the segmented cups.

The computer 127 has a plurality of outputs that are directed to motor control valves 128–135 associated with the disk 37, and motor control valves 136–143 associated with the disk 38. Each valve connects by an outlet into the individual disk cups between the disk and the liner 81. For example, the valve 128 connects by a manifold 144 to inlets 146 and 147, and the valve 136 connects to outlet 148. In the present arrangement, pressurized liquid is introduced by the valves 128–135 underneath the disk 37, conduits through space 91, and then exits by valves 136–143 on the overside of the disk 38.

The pressurized liquid is made available to valves 128–135 through circular manifold 149 and recovered from circular manifold via valves 136–143. The pressurized liquid is always held at a controlled and balancing head pressure in the system. For this purpose, the supply tank 152 is filled with compressed gas (e.g., air) by compressor 153 which is controlled by a pressure regulator 154. The outlet 156 from the tank 152 is applied to supply tanks 157 and 158 individually through motor control valves 159 and 161. These valves 159 and 161 are controlled by signals 162 and 163 from the computer 127, in response to feedback signals 164 and 166 from pressure sensors 167–168 versus calculated necessity. As a result, there are zones 169 and 171 of pressurized gas within the tanks 157 and 158. The integrated mean relative vertical position of sensors 116A–123A versus existing pressures will be the main computer input for calculating necessary mean and differential fluid pressures in tanks 157 and 158. Make-up liquid from a suitable source 170 (e.g., vessel's fresh water supply or seawater) is introduced by a pump 172 into the system by tank 157 through a motor control valve 173 actuated by level controllers 174 and 176. Liquid from the tank 158 is transferred into the tank 157 by the circulation pump 177 through a motor control valve 178 in regulation by a signal 179 from the computer 127. This flow equals the total system flow less fluid losses.

The manifold 149 receives pressurized liquid by a line 181 from the tank 157. The manifold 151 delivers returning pressurized liquid by a line 182 into the tank 158. A dual flow sensor 183 monitors the lines 181 and 182 for normal operation, and abnormalities (e.g., large leaks) are signals 184 sent to computer 127 for increasing liquid supply by opening valve 173.

Figure 10:
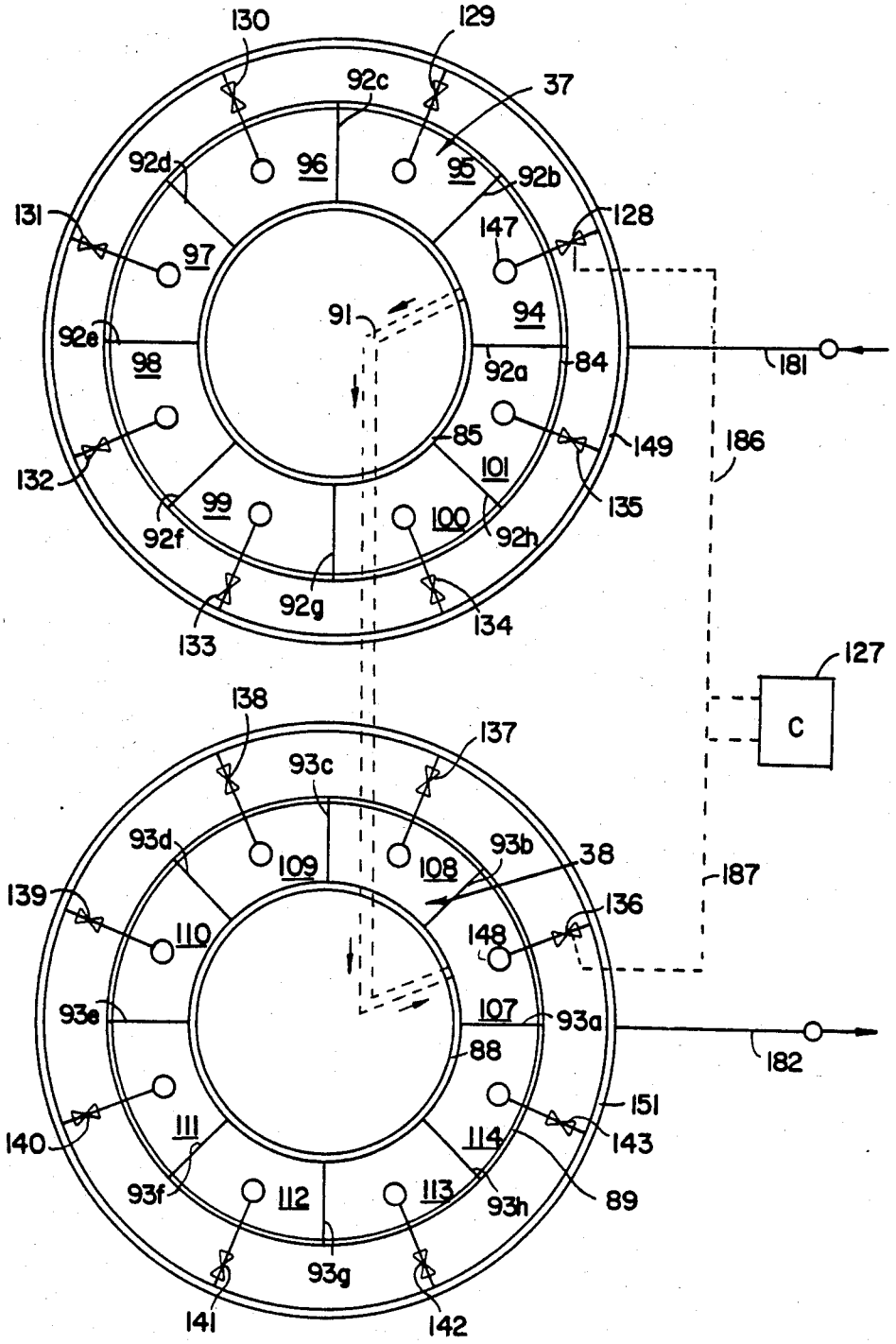
FIG. 10 is a diagrammatic presentation of the bearings (upper/lower) used in the improved turret at one operative connection to pressurized liquid applied by computer control.

Referring to FIG. 10, a description of typical operation of the pressurized system will be given. The disks 37 and 38 are shown in schematic with the plurality of segmented cups formed by the skirts and annular stoppers. The several inlets and their connection via the motor control valves are also illustrated, and the space 91 is shown in phantom as the fluid conduit from the disk 37 to the disk 38.

When the turret 16 is centered in the base 69, the sensors 116–123 provide equal signals to the computer 127 so that equal pressure is maintained in all cups by the motor control valves. This pressure balances the total load versus resulting lift in way of disks. For example, the pressurized liquid can be delivered to manifold 49 at 40 psig and is returned to manifold 136 at nearly the same pressure, less frictional induced drop, but plus the hydrostatic differential component.

If the turret is subject to an eccentric load, for example, it being displaced downward in way of sensor 116A, and upward in way of sensor 120A, the sensors 116 and 120 indicate the low and high sides of the disks relative to a programmed setpoint. The computer 127 by signals 186 and 187 increases the flow (and pressure) of the liquid entering the downside cups (e.g., cup 94). The resultant liquid pressure forces action on the disk 37 to restore the turret to its vertical axis and range, even while it is rotating. The same control system is applied to the cups 107–114 of the disk 38 using the respective motor control valves 136–143. In the above case, cup 107 is vented through opening valve 136, and an underpressure zone arises. Although the liquid differential pressure magnitude is not great, the moment arms and the large surface areas of the disk provide a hydraulic force (in the liquid trapped within the cups) capable of handling very large eccentric loads on the turret.

Another great advantage of this unique bearing arrangement to journal the turret is the ability to accommodate eccentric distortion of the parts, especially the base 69 and liners 80 and 81 positions. It will be apparent that the vessel 16 undergoes significant flexing in the form of sag, hog and tortional changes of its dimension, especially in the longitudinal axis of its hull. Assuming that the vessel construction is conventional, the hull undergoes about a 0.15% longitudinal distortion in tension and compression.

These elliptical distortions will primarily be absorbed in the elastomeric barrier 82. However, should the liners be affected by these relatively slow acting distortions, the watermasses between the base 69 and turret 16 will also have the ability to shift without significant pressure disturbance the way of the lifting areas underneath disk 37 and above disk 38.

Figure 6:
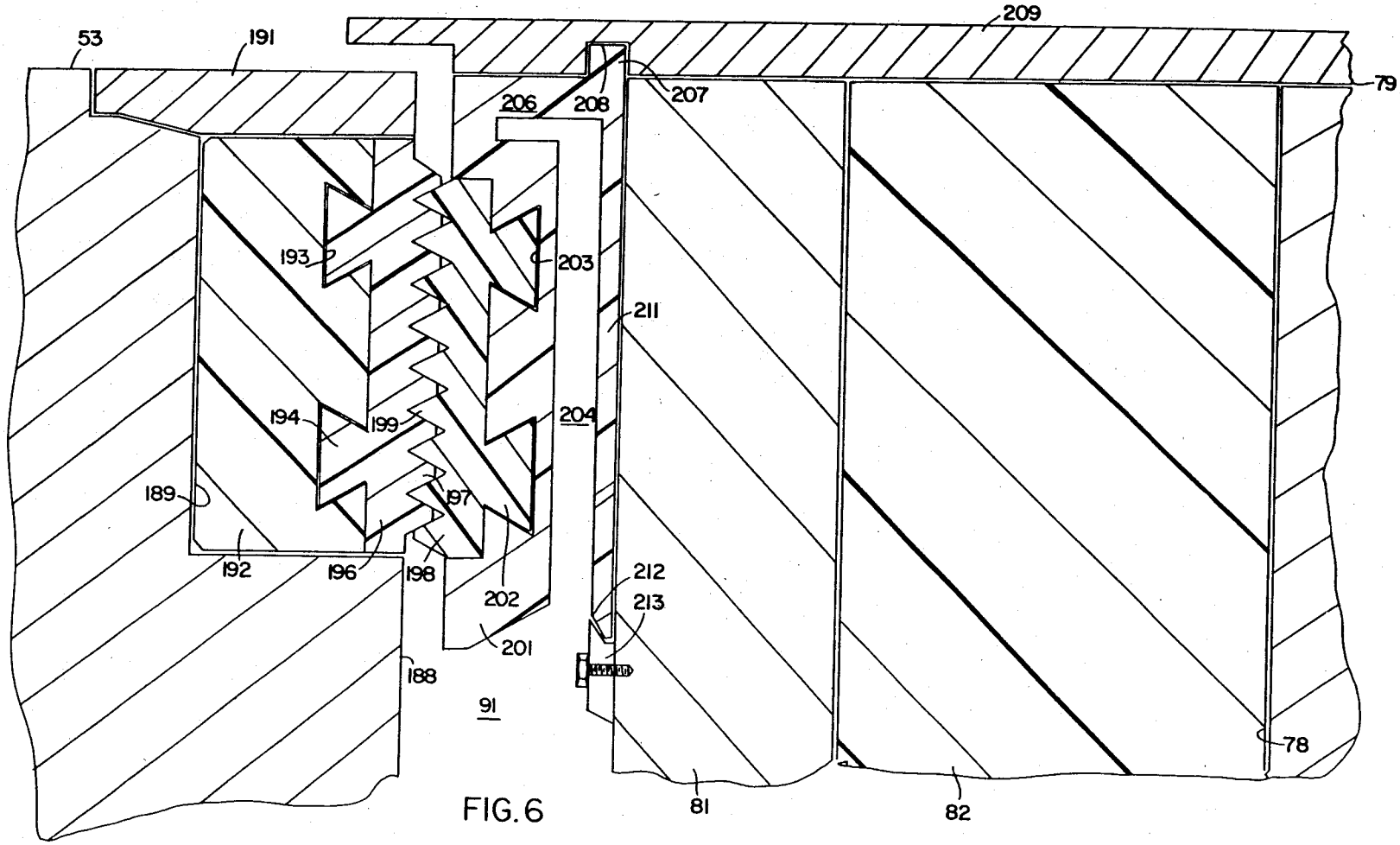
FIG. 6 is an enlarged cross section taken through the turret in FIG. 5 along lines 6—6.
Figure 8:
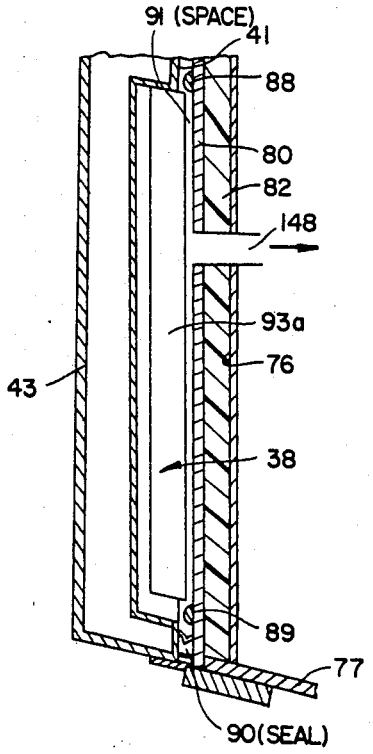
FIG. 8 is an enlarged section taken through the lower right portion of the turret along liens 8—8 in FIG. 2.

FIG. 6 shows a seal arrangement well adapted to the improved turret of this invention. This seal arrangement maintains fluid tightness during rotation of the turret, especially under eccentric loading or changes in shape of its parts. The disk 37 has an upright cylindrical wall 188 which extends to the circular top deck 53. A shouldered recess 189 is defined in the wall 188, and it is enclosed by an annular cover 191. An annular resilient sleeve 192 is seated in this recess 189 and secured in place by the cover 191. The sleeve 192 is provided with mounts, such as dovetail grooves 193 in which are received projections 194 which may be a flurocarbon (e.g., Teflon material) sealing ring 196. The exterior face of the ring 196 is provided with interleafed sealing surfaces 197 which can be saw-toothed in cross sectional configuration.

The base 69 carries a complementary sealing ring 198 which has interleafed sealing surface 199 engaged by the surfaces 197 sufficiently to form a tortous path type seal between liquid and atmosphere or watermasses. This sealing pressure can be provided by any mechanism, but preferably it is pressure actuated. For this purpose, an annular resilient sleeve 201 mounts the ring 198 by receiving its projections 202 with dovetail recesses 203. The sleeve 201 has an inverted u-shaped cross section providing a cylindrical chamber 204 open at one end to the pressurized liquid in space 91. The upper end 206 of the sleeve 201 is closed, and held by a ridge 207 within a groove 208 of a removeable circular cover 209. The exterior cylindrical side 211 of the sleeve 201 extends downwardly along the liner 81 to a tapered end 212 which is secured by a mounting ring 213 fixed to the liner 81.

With this seal arrangement for the seal 80, its parts can be easily removed and installed after the covers 191 and 209 uncover the recess 189 and space 91. The pressurized liquid acts through chamber 204 to force the ring 202 radially inwardly and thereby provide automatic fluid sealing engagement between the rings 196 and 198. Since these rings may be of a material with a very low coefficient of friction, and since their surfaces will be water lubricated, they produce only a relatively very insignificant increase in torque required to rotate the turret 16 within the base 69. Also, the seal arrangement accommodates relative movement between the turret and base responsive to heavy eccentric loading or elliptical changes in base shape.

Figure 11:
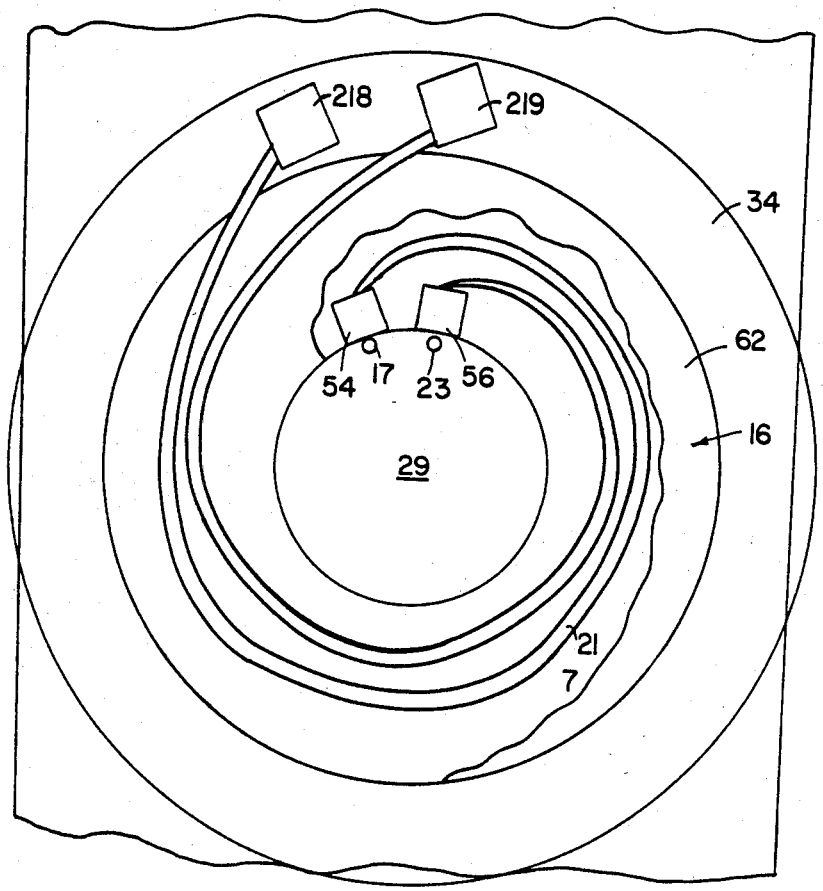
FIG. 11 is a pictorial presentation of the upper portion of the turret at the mooring and riser winches wherein their respective ropes are supplied through spiral rope guides.

The improved turret 16 is provided with a guide arrangement for conventionally feeding the large diameter mooring and riser ropes to their respective traction winches. As seen in FIG. 11 (with reference also to FIG. 2), the storage compartment is provided with a plurality of mooring and riser rope guides 216 and 217 for each set of rope winches. These guides are spiral and at their inner ends feed rope directly to the drums on the winches. The guides outer ends extend above the utility compartments and traverse the cover 62. Rope tensioning machines 218 and 219 can be mounted on the housing deck 34 for proper rope handling procedures. Usually, coiled supplies of rope are carried above deck, although in some vessels, a below deck storage arrangement could also be used to advantage. Although only one pair of mooring and riser rope guides arrangement are shown in FIG. 11, it will be apparent that there are as many pairs of guides as there are mooring and riser ropes used in the turret 16. In the present embodiment, there would be sixteen sets of mooring and riser rope guides, totaling 32, on the turret 16. The several cables concerning the utility compartments can be suitably arranged. As a result, the turret 16 can rotate about its vertical axis and yet the mooring and riser ropes will be continuously supplied to their respectful winches. The winches can be of any type such as selected from the winching types of cathead winches for chains, and drum and liner winches for synthetic and/or steel rope.

Many parts of the vessel 16 have been shown schematically, and it is understood that their position and construction follow conventional shop building principles. Details of construction have been shown only where necessary to a description of the present improved turret.

From the foregoing, there has been provided an improved turret for mooring a vessel and the vessel can weathervane about the turret to which is secured the several mooring and riser ropes, and the riser string or other subsea mechanism. It will be apparent that certain changes and alterations in this turret arrangement can be made without departing from the spirit of this invention. These changes are contemplated by and are within the scope of the appended claims which define the invention. Additionally, the present description is intended to be taken as an illustration of this invention.

What is claimed is:

1. An improved turret rotatable about a vertical axis within a support and adapted to operate subject to differential lateral and vertical loading, the improved turret comprising:

(a) a cylindrical spool carrying at least one radial bearing disk, and a round vertical body rotatable about the vertical axis;

(b) a supporting base adapted to receive said tubular spool within a defining enclosed wall;

(c) a stiff liner mounted within said supporting base in spaced relationship to said disk and said round body;

(d) an elastic medium positioned between said liner and said supporting base coextensive with said disk;

(e) a plurality of annular metal stop members mounted between said liner and said disk for spacing same a minimum distance apart;

(f) said disk carrying radial skirts for throttling liquid outlets between said disk and said liner and extending between said stop members for defining a plurality of annular segmented cups encircling said disk; and (g) source means for introducing pressurized liquid into each segmented cup for maintaining said spool balanced in vertical range and symmetrical with its vertical axis of rotation in said base.

2. The improved turret of claim 1 wherein said spool carries upper and lower disks in spaced relationship to said liner and at each end of said round body and said spool, and each of said disks are segregated into annular segmented cups residing between annular metal stop members and radial skirts.

3. The improved turret of claim 2 wherein resilient seals are carried between each of said disks and said base to define an enclosed fluid chamber including sid skirts and said annular stop members whereby the flow of said pressurized fluid is substantially throttled.

4. The improved turret of claim 1 wherein sensors are positioned to generate signals indicative of movement of said spool vertically and asymmetrically of its vertical axis of rotation, and control means to receive said signals and introduce the pressurized liquid into corresponding segmented cups on said disk in magnitudes to return said spool into its balanced vertical range and its vertical axis position.

5. The improved turret of claim 4 wherein said control means includes reservoir means of the liquid pressurized in sufficient range to maintain said disk out of contact with said metal stop members during symmetrical loading of said spool and pump means increase the pressure magnitude of the liquid only to such segmented cups as is required to maintain rotation of said spool in said body when unbalanced in vertical range and asymmetrical loading is imposed upon said spool.

6. The improved turret of claim 1 wherein said disk is frusto-conical in the region carrying said radial skirts.

7. The improved turret of claim 6 wherein said liner is frusto-conical between said annular stop members.

8. The improved turret of claim 1 wherein said disk and liner have coextensive frusto-conical surfaces extending over the region between said annular stop members and said skirts, and said annular stop members are spaced a small dimension from said frusto-conical surfaces on said disk to provide a positive stop surface upon movement of said spool under varying loading whereby substantial displacement forces are absorbed in said elastic medium in the event said source means fails to introduce sufficient pressurized liquid to said segmented cups for maintaining said spool in balanced vertical range and symmetrical with its vertical axis of rotation in said base.

9. The improved turret of claim 1 wherein said elastic medium are intermittent layers of synthetic polymeric rubber.

10. The improved turrent of claim 1, wherein said elastic medium consists of discrete bodies of porous elastic meterial.

11. The improved turret of claim 1, wherein said elastic medium consists of inflated spheres contained in a confined pressurized liquid.

12. An improved turret rotatable about a vertical axis within a support on a vessel and adapted to operate subject to differential lateral and vertical loading, the improved turret comprising:

(a) a cylindrical spool carrying upper and lower frusto-conical disks and a round vertical body rotatable about a vertical axis;

(b) a supporting base mounted in said vessel in an upright opening forming a moon pool, and said base adapted to receive said spool within watertight enclosing walls;

(c) rigid liners mounted within said base and in spaced relationship to said disks and said body of said spool and said enclosing wall;

(d) an elastic medium positioned between said liners and said enclosing wall and extending coextensively with said frusto-conical disks;

(e) a plurality of annular metal stop members mounted between said liners and said disks for spacing said liners and said disks apart a minimum lateral and vertical distance;

(f) said disk carrying radial skirts for sealing said disk to said liner and said skirts extending between some of said stop members whereby a plurality of annular segmented cups are defined encircling said disks; and (g) source means for introducing pressurized liquid into said segmented cups for maintaining said spool in balanced vertical range and symmetrical with its vertical axis of rotation in said base.

13. The improved turret of claim 12 wherein resilient seals are carried between said spool and base to define an enclosed chamber including said elastic skirts and annular stop members, a plurality of sensors are positioned circumferentially about said spool to generate signals indicative of any movement of said spool about its vertical working range and its vertical axis of rotation in said base, and control means to receive said signals for introducing pressurized fluid into said segmented cups on said disk in magnitudes sufficient to maintain said spool into its vertical working level and vertical axis position.

14. The improved turret of claim 13 wherein said spool is tubular with a substantially cylindrical inner wall concentric with its vertical axis of rotation traversing said moon pool in the vessel.

15. The improved turret of claim 14 wherein said spool has a plurality of annular compartments provided adjacent its upper surface and said compartments are circumferentially spaced about and adjacent said inner wall contains winches for handling ropes extending downwardly through said moon pool.

16. The improved turret of claim 15 wherein said winches are of the traction type are provided with individual supplies of rope carries on the vessel and supplied to said winches via spiral guides extending through said spool.

17. The improved turret mooring of claim 16 wherein some of the winches handle mooring ropes and other winches handle riser ropes, said mooring ropes positioning the vessel relative to a subsea wellhead and said riser ropes position parts of a riser string related to the wellhead whereby the vessel can weathervane relative to the wellhead but said turret remains angularly stationary.

18. The improved turret of claim 17 wherein said mooring ropes pass downwardly over sheeves carried at the foot of said round body on said spool and said riser ropes generally pass downwardly.

19. The improved turret of claim 18 wherein said winches handling mooring ropes are angularly offset from said winches handling riser ropes whereby the mooring and riser ropes run parallel along the inner wall of said spool.

20. The improved turret of claim 12 wherein said control means includes a reservoir vessel of liquid pressurized to a first magnitude to float said spool in said base and pump means supply selectively the pressurized liquid at an elevated pressure to the upper disk's segmented cups and selectively venting from the lower disk's segmented cups as necessary to return said spool to its vertical working level and its vertical axis of rotation in said base and a throttling passage connects the upper and lower disk's segmented cups.

21. The improved turret of claim 13 wherein resilient annular seals are carried between said spool and base to define an enclosed chamber including said elastic skirts and annular stop members, and each said resilient seal comprising a pair of concentric, segmented annular rings having interleafed sealing surfaces, one ring carried on said spool and the other ring carried on said base, and said interleafed surfaces providing a dynamic seal against significant loss of pressurized liquid from said enclosed chamber.

22. The improved turret of claim 21 wherein said interleafed sealing surfaces is a low friction flurocarbon polymer such as Teflon.

23. The improved turret of claim 22 wherein said interleafed sealing surfaces are saw-toothed in cross sectional configuration.

24. The improved turret of claim 21 wherein said ring carried on said base is circumferentially enclosed by an annular resilient sleeve, and said sleeve having a central annular opening conduiting to the liquid pressure in enclosed chamber whereby pressurized liquid in said sleeve urges said annular rings into substantially fluid tight sealing relationship, and where the sealing surface pressures are automatically a function of the sealed medium pressure.

25. An improved turret rotatable about a vertical axis within a support on a vessel, the improvement comprising:

(a) a cylindrical spool with upper and lower radially extending bearing disks with a round upright body rotatable about a vertical axis and passing through the main deck of the vessel;

(b) a supporting base mounted forward of mid length of the vessel in an upright opening forming a moon pool, and said base adapted to receive said spool within watertight enclosing walls;

(c) said bearing disks and base carrying pressurized liquid bearing surfaces to journal said spool for rotation within said base about the vertical axis;

(d) said spool at its upper end carrying segmented and annular chambers adapted to mount mooring and riser rope handling winches and to provide storage and utility areas;

(e) said spool having a top deck above said chambers and mounting annular and transverse skids whereby deck carried equipment can be slid into operative position relative to said moon pool; and (f) said spool at its lower end carrying sheeves for passing ropes downwardly through said moon pool.

26. The improved turret of claim 25 wherein spiral rope guides end from the exterior circumference of said spool downwardly through said chambers to each said winch whereby ropes in deck storage can be fed to said winches.

27. The improved turret of claim 25 wherein coiled supplies of ropes are carried in said storage chambers and guides to feed the rope between the storage chambers and said winches.

28. The improved turret of claim 25 wherein said mooring winches are spaced uniformly about said spool and said riser winches are distributed between said anchor winches whereby the mooring ropes and riser ropes alternate in parallel distribution in their passing downward through said moon pool.

29. The improved turret of claim 25 wherein said winches are cathead winches.

30. The improved turret of claim 25 wherein said winches are drum winches.

31. The improved turret of claim 25 wherein said winches are linear winches.

32. A turret rotatable about a vertical axis within a support, comprising:

(a) a cylindrical spool rotatable about the vertical axis and carrying at least one radial bearing disk;

(b) the support adapted to receive said spool within a concentric enclosed wall;

(c) a plurality of annular metal stop members mounted between the support and said spool for spacing said spool and the support a minimum distance apart;

(d) a plurality of radially aligned metal skirts mounted on said disk and extending between said stop members for defining a plurality of annular segmented cups encircling said disks; and (e) source means for introducing pressurized liquid into each segmented cup for maintaining said spool balanced in vertical range and symmetrical with its vertical axis of rotation in said base.

* * * * *